United States Patent [19]

Gilkerson et al.

[11] 4,083,216

[45] Apr. 11, 1978

[54] SUPPORT PIN FOR CLAMPING DIE ASSEMBLY

[75] Inventors: Robert L. Gilkerson, Yorkville; Donald W. Griggs; James B. Hadley, both of Aurora, all of Ill.

[73] Assignee: Caterpillar Tractor Co., Peoria, Ill.

[21] Appl. No.: 797,266

[22] Filed: May 16, 1977

[51] Int. Cl.[2] ..... B21D 7/04

[52] U.S. Cl. ..... 72/149

[58] Field of Search ..... 72/149, 150, 151, 152, 72/153, 154, 155, 156, 157, 158, 159

[56] References Cited

U.S. PATENT DOCUMENTS

| | | | |
|---|---|---|---|
| 643,760 | 2/1900 | Brinkman | 72/155 |
| 749,029 | 1/1904 | Condon | 72/158 |
| 2,702,065 | 2/1955 | Franck | 72/157 |
| 2,938,565 | 5/1960 | Klamm | 72/154 |
| 3,261,193 | 7/1966 | Van Harten | 72/155 |
| 3,433,042 | 3/1969 | Crihfield et al. | 72/159 |
| 3,448,602 | 6/1969 | Stanley et al. | 72/149 |

*Primary Examiner*—E. M. Combs

*Attorney, Agent, or Firm*—Phillips, Moore, Weissenberger, Lempio & Majestic

[57] ABSTRACT

A clamping die assembly comprises a rotatable platen having first and second die members mounted thereon for rotation therewith. The second die member is adapted to reciprocate on the platen to engage the first die member to clamp a tube therebetween. A rearward end of the tube is fixedly held and the platen is rotated to wrap the tube around a die cavity formed in the first die member. A pin is reciprocally mounted on the first die member, adjacent to and below the die cavity, to support the tube prior to clamping of the tube between the die members. A coil spring normally biases the pin to an extended position to support the tube and compresses upon clamping of the die members together whereby the pin is retracted within the confines of the first die member.

10 Claims, 4 Drawing Figures

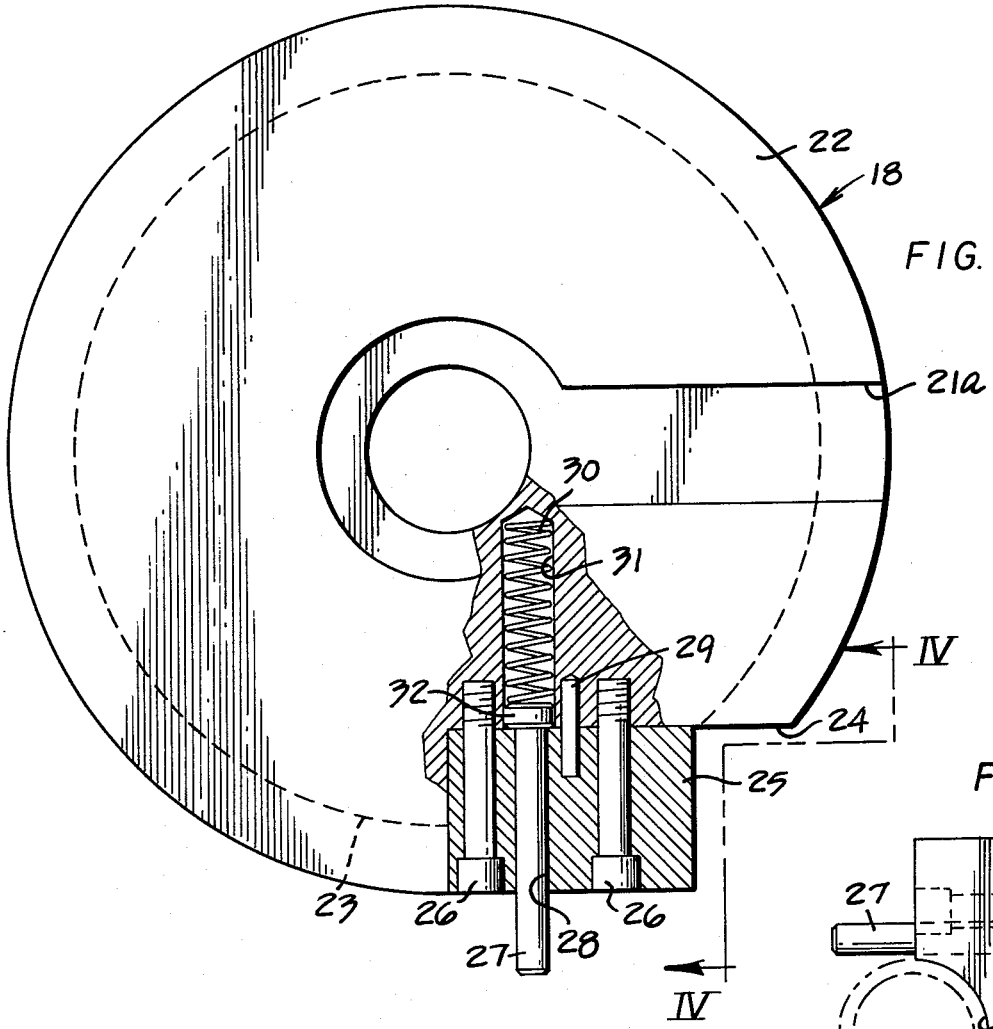
FIG. 2.
FIG. 4.
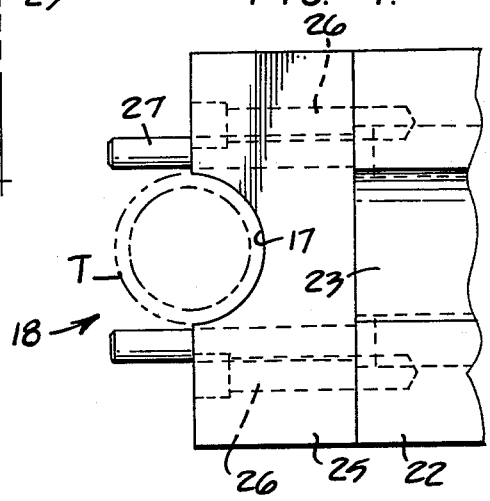
FIG. 3.
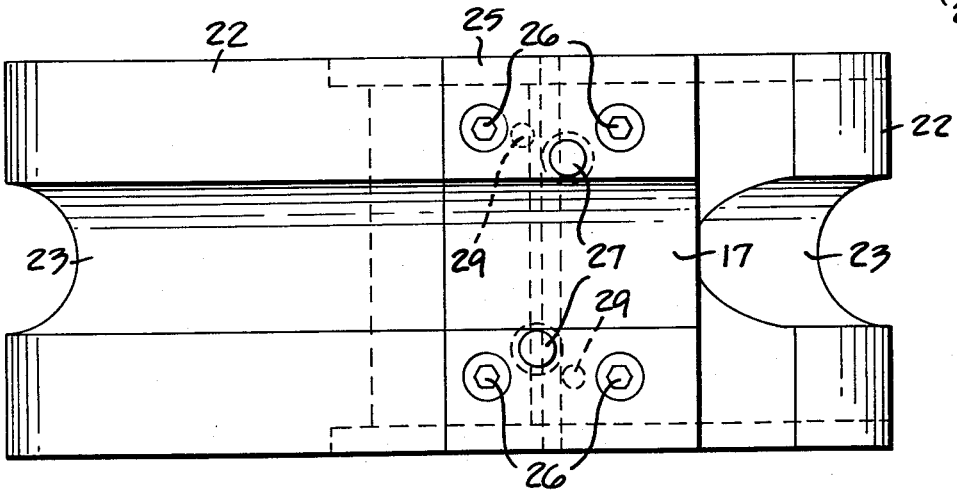

SUPPORT PIN FOR CLAMPING DIE ASSEMBLY

BACKGROUND OF THE INVENTION

A conventional clamping die comprises a pair of die members mounted on a platen with one of the die members being reciprocally mounted thereon whereby the die members may be clamped together to retain a tube therebetween. Prior to such clamping, a workman normally holds the tube in position within a die cavity formed in one of the members. Failure to precisely maintain the tube in position prior to clamping of the die members together could result in tube deformation and potential damage to the die members. The tube is bent by rotating the platen, subsequent to the clamping of the tube between the die members.

SUMMARY OF THE INVENTION

The present invention is directed to overcoming one or more of the problems as set forth above.

The die assembly of this invention comprises a generally annular die member having a die cavity formed thereon. A support pin is reciprocally mounted on the die member, adjacent to and vertically below the die cavity, to reciprocate between a retracted position within the confines of the die member and an extended position whereby an end of the pin is disposed radially outwardly beyond the periphery of the die member. A biasing means is mounted in the die member to bias the support pin towards its extended position whereby it is adapted to support a tube to be bent by the die assembly. This invention thus eliminates workman contact with the tube whereby his hands are freed to actuate electronic controls utilized for the bending process.

BRIEF DESCRIPTION OF THE DRAWINGS

Other objects of this invention will become apparent from the following description and accompanying drawings wherein:

FIG. 2 is an enlarged top plan view of a die member employed in the clamping die assembly;

FIG. 3 is a front elevational view of the die member; and

FIG. 4 is a partial view of the die member, taken in the direction of arrows IV—IV in FIG. 2.

DETAILED DESCRIPTION

Figure 1:
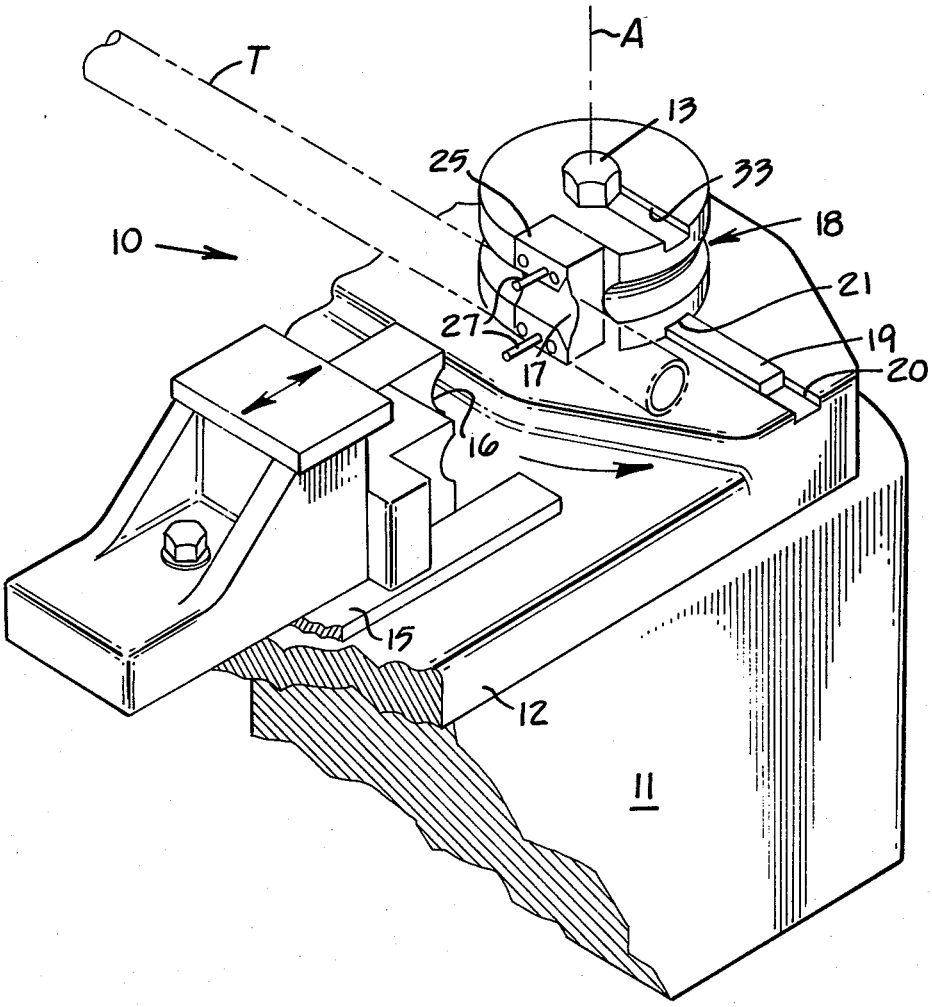
FIG. 1 is a partial isometric view of a clamping die assembly embodying this invention.

FIG. 1 illustrates a die assembly 10 comprising a stationary support 11 which may comprise the housing of a motor. The horizontally disposed platen 12 is mounted on support 11 in a conventional manner for rotation about a vertically disposed axis A which is coincident with the axes of an output shaft of the motor and a bolt 13. A first die member 14 is mounted on a pair of laterally spaced and parallel guide rails 15 (one shown), secured to the platen 12.

A conventional actuating means (not shown), such as a double-acting cylinder, is suitably interconnected between the platen and first die member 14 to reciprocate the die member on the platen. A die cavity 16, having a semi-cylindrical cross section, is formed forwardly on the die member to be moved into confronting relationship with respect to a die cavity 17, formed on a second die member 18. Second die member 18 is generally annular and is secured to platen 12 by bolt 13 and a key 19, disposed in keyway slots 20 and 21 formed in the platen and in the second die member, respectively.

Referring to FIGS. 2–4, die member 18 comprises a body portion 22 having a die cavity 23 formed on the periphery thereof which forms an extension of die cavity 17. The die cavities have a semi-circular cross section to adapt them for reception of tube T therein. A notch 24 is formed in body portion 22 of the second die member to receive a block 25, secured to the body portion by four cap screws 26.

A pair of vertically spaced support pins 27 are each reciprocally mounted in a bore 28 formed through block 25. As more clearly shown in FIG. 2, a pair of locating pins 29 aid in precisely locating block 25 in position on the die member. A biasing means, preferably in the form of a compression coil spring 30 is mounted in a bore 31 formed in the die member and is disposed in axial alignment with respect to bore 28.

The spring biases pin 27 towards its illustrated extended position whereby an end of the pin is disposed radially outwardly beyond the periphery of the die member cavities 17 and 23. A head 32 is formed on the opposite end of the pin. The head provides a stop means for precisely maintaining the pin in its predetermined extended position on the die member.

Referring once again to FIG. 1, in operation a workman will load tube T in its illustrated position, resting on lower pin 27. The workman is thus physically removed from the working area of the clamping die assembly and his hands are freed to actuate electronic controls for the bending apparatus. The conventional actuating means (not shown) operatively connected to first die member 14 is actuated to mve the die member rightwardly into clamping engagement with die member 18. Pins 27 will automatically retract within the confines of die member 18 and confronting die cavities 16 and 17, ahving a composite internal diameter slightly larger than the outside diameter of tube T, will clamp the tube therebetween.

The rearward end of the tube is then suitably held by a remote collet or chucking fixture (not shown). The motor contained within housing 11 is then actuated to rotate platen 12 generally counterclockwise, as shown by the arrow in FIG. 1, to bend the tube into a radius within die cavity 23 of die member 18. A second keyway slot 33 is formed on the upper side of die member 18 and is a substantial mirror image of keyway slot 22. Thus, upon removal of bolt 13 from an output shaft (not shown) of the drive motor, the die member is adapted to be reversed to adapt it for use on either a right or left-handed machine.

We claim:

1. A clamping die assembly comprising
   a generally annular die member,
   means defining a die cavity on a periphery of said die member,
   a support pin reciprocally mounted on said die member, adjacent to and vertically below said die cavity, for reciprocal movements between a retracted position within the confines of said die member and an extended position disposing an end of said pin radially outwardly beyond the periphery of said die member and said die cavity, and
   biasing means mounted in said die member for biasing said support pin towards its extended position.

2. The clamping die assembly of claim 1 wherein said die member comprises a body portion having a notch formed on the periphery thereof and fastening means releasably securing a block member to said body portion, said die cavity continuously formed on said block and on said bodyportion.

3. The clamping die assembly of claim 2 further comprising at least one locating pin mounted in said block member and the body portion of said die member.

4. The clamping die assembly of claim 2 wherein said biasing means comprises a spring mounted in said body portion and engaging an end of said support pin.

5. The clamping die assembly of claim 4 further comprising stop means formed on an end of said pin and having one side thereof engaged by said spring and having an opposite side thereof engaging said block member to precisely maintain said pin in its extended positon.

6. The clamping die assembly of claim 1 wherein said biasing means comprises a coil spring mounted in said die member to engage an end of said pin and a head formed on said pin engaging said spring and providing stop means for precisely maintaining said pin in its extended position.

7. The clamping die assembly of claim 1 further comprising a platen having said die member secured thereon and another die member reciprocally mounted on said platen, adjacent to said first-mentioned die member, and having a die cavity formed thereon adapted to be moved into confronting relationship with respect to the die cvity formed on said first-mentioned die member for clamping a tube therebetween.

8. The clamping die assembly of claim 7 wherein said first-mentioned die member is secured against rotation on said platen by opposed keyway slots formed on an upper side of said platen and on an underside of said first die member and a common key disposed in said slots.

9. The clamping die assembly of claim 8 further comprising another keyway slot formed on an upper side of said die member and wherein a pair of support pins are reciprocally mounted on either side of said die cavity whereby said die member is adapted to be reverse mounted on said plten.

10. The clamping die assembly of claim 1 wherein a pair of vertically spaced support pins are reciprocally mounted on said die member on either side of said die cavity.

* * * * *